US010119357B2

(12) United States Patent
Roselier et al.

(10) Patent No.: US 10,119,357 B2
(45) Date of Patent: Nov. 6, 2018

(54) TUBULAR ELEMENT WITH DYNAMIC SEALING AND METHOD FOR APPLYING SAME AGAINST THE WALL OF A WELLBORE

(71) Applicant: Saltel Industries, Bruz (FR)

(72) Inventors: Samuel Roselier, Le Rheu (FR); Jean-Louis Saltel, Le Rheu (FR); Robin Laupie, Rennes (FR); Samuel Mouget, Caouennec (FR)

(73) Assignee: Saltel Industries (FR)

( * ) Notice: Subject to any disclaimer, the term of this patent is extended or adjusted under 35 U.S.C. 154(b) by 240 days.

(21) Appl. No.: 14/915,131

(22) PCT Filed: Aug. 4, 2014

(86) PCT No.: PCT/EP2014/066702
§ 371 (c)(1),
(2) Date: Feb. 26, 2016

(87) PCT Pub. No.: WO2015/028257
PCT Pub. Date: Mar. 5, 2015

(65) Prior Publication Data

US 2016/0208573 A1 Jul. 21, 2016

(30) Foreign Application Priority Data

Aug. 28, 2013 (FR) ..... 13 58224

(51) Int. Cl.
*E21B 33/127* (2006.01)
*E21B 33/124* (2006.01)
(Continued)

(52) U.S. Cl.
CPC ..... *E21B 33/128* (2013.01); *E21B 33/1216* (2013.01); *E21B 33/1277* (2013.01)

(58) Field of Classification Search
CPC .. E21B 33/124; E21B 33/127; E21B 33/1277; E21B 33/1285; E21B 33/1216; E21B 23/01
See application file for complete search history.

(56) References Cited

U.S. PATENT DOCUMENTS 2,368,428 A * 1/1945 Saurenman ..... E21B 43/14 166/114
5,676,384 A 10/1997 Culpepper
(Continued)

FOREIGN PATENT DOCUMENTS

EP 2479376 A1 7/2012

OTHER PUBLICATIONS

International Search Report for Application No. PCT/EP2014/066702 dated Sep. 23, 2014.

*Primary Examiner* — Kenneth L Thompson
(74) *Attorney, Agent, or Firm* — Lerner, David, Littenberg, Krumholz & Mentlik, LLP

(57) ABSTRACT

The invention concerns a radially expandable metal tubular element having on its outer surface a series of spaced apart annular sealing modules. This element is noteworthy in that each sealing module comprises two annular metal abutments between which there are inserted an annular seal and two anti-extrusion rings, the seal being positioned between the two anti-extrusion rings and the two metal abutments being secured against the outer surface of the said tubular element, in that the two anti-extrusion rings are made in elastically and plastically deformable material and are in one or two parts, and in that the two anti-extrusion rings and/or the seal comprise at least two opposite facing bevelled surfaces capable of sliding relative to one another under the effect of axial movement of the said seal so as to cause outward radial displacement of one of the anti-extrusion rings or at least one of the two parts thereof.

18 Claims, 7 Drawing Sheets

(51) Int. Cl.
*E21B 33/128* (2006.01)
*E21B 33/12* (2006.01)

(56) References Cited

U.S. PATENT DOCUMENTS

| | | | | |
|---|---|---|---|---|
| 6,123,148 | A | 9/2000 | Oneal | |
| 6,598,672 | B2 * | 7/2003 | Bell | E21B 33/1216 166/118 |
| 6,640,893 | B1 | 11/2003 | Rummel et al. | |
| 7,070,001 | B2 | 7/2006 | Whanger et al. | |
| 7,370,708 | B2 | 5/2008 | Simpson et al. | |
| 9,206,666 | B2 * | 12/2015 | Hallundbæk | E21B 33/12 |
| 9,506,314 | B2 * | 11/2016 | Roselier | E21B 33/12 |
| 9,670,747 | B2 * | 6/2017 | Ruffo | E21B 33/1216 |
| 2004/0007366 | A1 | 1/2004 | McKee et al. | |
| 2012/0205872 | A1 | 8/2012 | Reinhardt et al. | |
| 2013/0192853 | A1 | 8/2013 | Themig | |
| 2014/0299334 | A1 * | 10/2014 | Hallundbæk | E21B 33/1208 166/387 |
| 2015/0068774 | A1 * | 3/2015 | Hallundbæk | E21B 33/127 166/387 |
| 2016/0348463 | A1 * | 12/2016 | Vasques | E21B 33/1277 |

* cited by examiner

TUBULAR ELEMENT WITH DYNAMIC SEALING AND METHOD FOR APPLYING SAME AGAINST THE WALL OF A WELLBORE

CROSS REFERENCE TO RELATED APPLICATIONS

The present application is a national phase entry under 35 U.S.C. § 371 of International Application No. PCT/EP2014/066702, filed Aug. 4, 2014, published in English, which claims priority from French Patent Application No. 1358224, filed Aug. 28, 2013, the disclosures of which are incorporated by reference herein.

BACKGROUND OF THE INVENTION

The present invention lies in the field of well drilling.

It more particularly relates to a radially expandable metal tubular element having on its outer surface a series of spaced apart, annular sealing modules.

The invention also concerns a device to isolate part of a wellbore comprising a pipe provided on a section of its outer surface with at least one of the aforementioned expandable tubular elements.

Finally the invention concerns a method for the sealed applying of the aforementioned isolating device against the wall of a wellbore or casing placed inside this wellbore.

The invention can be applied to the tubing of a vertical or horizontal wellbore.

This second wellbore configuration has been given more general use in recent years further to new extraction techniques and in particular, but not limited thereto, hydraulic fracturing techniques.

The operating of wellbores, whether vertical or horizontal, requires the sealing of some regions of the wellbore in relation to others, for example to delimit an area inside which it will later be possible to conduct operations.

To illustrate the state of the art in the matter appended FIGS. 1 and 2 illustrate a fraction of a metal tubular pipe known as a "base pipe" BP or casing, which is placed in position inside a well and more particularly in the horizontal part thereof.

In practice this base pipe BP also comprises a vertical upstream end which leads into the surface of the wellbore, and a curved intermediate portion to connect the vertical part with the horizontal part (these not being illustrated for reasons of simplification).

It is a tubular pipe formed of several sections placed end to end so as to form a completion.

In the two aforementioned Figures, the pipe BP is positioned in an open wellbore A whose surface is as drilled.

However it can easily be envisaged that A designates a metal tube (casing) in which it is intended to conduct operations.

Against the outer surface of this base pipe BP and on a portion thereof there extends a cylindrical or approximately cylindrical jacket C whose opposite ends are sealingly secured to the outer surface of the pipe, for example via rings B. This jacket is preferably in metal.

At least one opening O is arranged in the wall of the base pipe BP to cause its inner space to communicate with the annular space arranged between the wall of the base pipe BP and the jacket C.

In the appended Figures only one opening O is illustrated. However it is possible to have a higher number of openings e.g. four or six.

Still as known per se the jacket C is covered over all or part of its length with a layer of elastically deformable material e.g. elastomer which forms an annular sealing «web» D a few millimeters thick.

In FIG. 1 the jacket C is shown in its initial state, namely its wall is not yet deformed. At this stage it is globally cylindrical. The wellbore is at absolute pressure P0.

As shown in FIG. 2, sufficient fluid pressure P1 is applied (preferably a liquid such as water) inside the base pipe BP. This pressure, via the openings O, is communicated inside the jacket C which expands radially beyond its elastic deformation limit.

By so doing the web D of elastomer material comes into contact with the inner wall A of the wellbore or casing.

By then applying an overpressure ΔP, so that the overall pressure becomes P1+□P, the sealing web D is compressed against the wall thereby sealingly isolating the annular spaces EA1 and EA2 arranged either side of the jacket C.

When the pressure is lowered inside the base pipe BP for return to initial pressure P0, the diameter of the jacket C tends to reduce slightly on account of elastic return. This geometric modification must be offset by the sealing layer D to maintain proper isolation between the aforementioned annular spaces.

The reference Z in FIG. 2 designates a zone which is magnified in appended FIGS. 3 and 4.

FIG. 3 illustrates the device during expansion of the jacket whilst FIG. 4 shows the device after release of the expansion pressure. Since the elastomer of the web D is relatively little compressible, it is only scarcely compressed even after the application of strong overpressure and contact with the wall of the wellbore A.

This overpressure may be in the order of 50 to 100 bars.

After release of the pressure (return to initial pressure P0) and hence after elastic return of the jacket C, it is then possible that there is no longer any contact between the inner wall of the wellbore and the web of material D, thereby leaving a communication space j between the aforementioned annular spaces EA1 and EA2.

Under these conditions no satisfactory seal is obtained.

It has also been proposed not to use a continuous web D of sealing material but a series of annular sealing strips spaced apart as described in document U.S. Pat. No. 6,640,893 and illustrated in appended FIG. 5.

When considering the cross-section of these sealing strips E it can be seen that they are separated from one another by annular spaces F.

Most of the time the jacket C is expanded even though the well is filled with water which means that this liquid is trapped between the sealing strips in the spaces F.

This liquid being scarcely compressible, the pressure □P is trapped between the sealing strips E and the fluid can no longer be evacuated.

The same phenomenon of defective sealing is then observed as described above in connection with FIGS. 3 and 4, since the elastomer is not able to be sufficiently compressed and is unable to offset elastic return.

Other techniques for deforming an expandable jacket have been proposed.

For example document U.S. Pat. No. 7,370,708 describes a device comprising not a sealing layer in elastomer but metal lips directly secured to the expandable jacket.

On expansion of the jacket which is obtained using a mandrel sliding longitudinally, these lips are plastically deformed in turn against the wall. The low elastic return of these lips is not sufficient to offset the elastic return and reduction in diameter of the actual jacket, which leaves a communication space between the two annular spaces EA1 and EA2.

Also, document U.S. Pat. No. 7,070,001 relates to sealing lips secured to an expandable jacket and parallel to the axis thereof. These are coupled to sealing layers in inflatable elastomer.

The described jacket is deformed by a rotating tool system with rollers.

It will be noted that the two above-mentioned devices do not allow an annular isolating device to be obtained wherein an expandable jacket C is arranged around a base pipe BP.

BRIEF SUMMARY OF THE INVENTION

It is therefore the objective of the invention to solve the aforementioned disadvantages of the prior art and to provide a metal tubular element which is radially expandable via hydroforming, equipped on its outer surface with a series of annular sealing modules which fully meet their function when applied to the walls of a casing or wellbore.

This sealing function must be ensured irrespective of the liquid or gaseous medium in which expansion takes place.

In cases in which this expandable tubular element is applied to the forming of a device to isolate part of a wellbore, the annular sealing modules must also ensure their function when a pressure is applied in the annular space EA1 or EA2 existing between two successive devices.

Still for this same application of forming an isolation device, a further objective of the invention is to allow the progressive application of the sealing modules against the wall from the centre outwards, so as to expel any water which may be contained in the annular space between the wall of the wellbore and the base pipe BP.

For this purpose the invention concerns a radially expandable metal tubular element having on its outer surface a series of spaced apart sealing modules.

Conforming to the invention, each sealing module comprises two annular metal abutments between which there are inserted an annular seal and two anti-extrusion rings, the seal being positioned between the two anti-extrusion rings and the two metal abutments being secured against the outer surface of said tubular element, the two anti-extrusion rings are made in elastically and plastically deformable material and are in one or two parts, and the two anti-extrusion rings and/or seal comprise at least two opposite facing bevelled surfaces capable of sliding relative to one another under the effect of axial movement of the said seal, so as to cause radial outward displacement of one of the anti-extrusion rings or at least one of the two parts thereof.

According to other advantageous, non-limiting characteristics of the invention, taken alone or in combination:

- each anti-extrusion ring is in one part and the said bevelled surfaces are respectively arranged on each anti-extrusion ring and on each lateral surface of the seal;
- each anti-extrusion ring is in two parts and the said bevelled surfaces are respectively arranged on each of these two parts;
- the anti-extrusion rings and the metal abutment comprise at least two opposite facing bevelled surfaces capable of sliding relative to one another under the effect of axial movement of the seal, so as to cause outward radial displacement of one of the anti-extrusion rings;
- the tubular element is in steel of stainless type;
- the metal abutments are in steel of the same type as the tubular element;
- the said bevelled surfaces lie at an angle between 20° and 70° relative to the outer surface of the tubular element;
- the said bevelled surfaces lie at angle of about 45° relative to the outer surface of the tubular element;
- the anti-extrusion rings are made in material selected from polytetrafluoroethylene (PTFE) and poly(etheretherketone) (PEEK).

The invention also concerns a device to isolate part of a wellbore.

According to the invention it comprises a pipe provided over a section of its outer surface with at least one metal tubular element such as described above, the opposite ends of this tubular element being secured to the said outer surface of the pipe so as to delimit an annular space between the outer surface of the pipe and this tubular element, the wall of the said pipe having at least one opening allowing it to communicate with said annular space, the metal tubular element being radially expandable so that over part of its length with the exception of its end parts it is sealingly applied against the wall of the wellbore.

According to other characteristics:

- the sealing modules provided on said metal tubular element lie closer to each other at the ends of the said metal tubular element and are more spaced apart in the central portion of this tubular element;
- the metal abutments of the sealing modules positioned in the central portion of the tubular element are narrower and/or thinner than the metal abutments of the sealing modules positioned at the ends of the tubular element;
- the annular seals of the sealing modules positioned in the central portion of the tubular element are narrower and/or thinner than the annular seals of the sealing modules positioned at the ends of the tubular element;
- it comprises a pipe provided on one section of its outer surface with at least two metal tubular elements such as aforementioned, the portion of pipe located between the two tubular elements having a set of through openings able to be obturated by mobile shutoff means;
- it comprises a second so-called «inner» metal tubular element that is radially expandable, devoid of sealing modules and arranged coaxially inside the so-called «outer» tubular element and whose ends are secured to the outer surface of the pipe, and there is at least one orifice placing the annular space arranged between the outer surface of the inner tubular element and the inner surface of the outer tubular element in communication with the space arranged outside of the pipe and the outer tubular element.

The invention also concerns a method for the sealed applying of the aforementioned tubular element against the wall of a wellbore or casing placed inside this wellbore, this element being previously positioned inside the said wellbore or said casing.

This method comprises the following steps:

a) radial expanding under a first pressure of the said metal tubular element until the central sealing modules come into contact with the said wall;

b) applying, for a predetermined time, an increasing overpressure until the sealing modules positioned either side of the central modules progressively come into contact with the said wall from the centre towards the ends of the tubular element;

c) releasing the said pressure inside the said metal tubular element, the annular seals remaining in contact with the wall (A) of the wellbore or casing;

steps a) and b) to apply pressure are performed by hydroforming or using an inflatable tool.

Finally the invention relates to the method for the sealed applying of the aforementioned device against the wall of a wellbore or casing placed inside this wellbore. In addition to above steps a) to c), the method comprises the following additional step:

d) applying pressure in the annular space arranged between the pipe, the wall and two successive metal tubular elements, until the seal is axially moved against one of the anti-extrusion rings causing the outward radial displacement thereof or part thereof so as to fill the clearance existing between the metal abutment and the wall of the wellbore.

BRIEF DESCRIPTION OF THE DRAWINGS

Other characteristics and advantages of the invention will become apparent from the description given below with reference to the appended drawings which by way of non-limiting indication illustrate several possible embodiments.

In these drawings.

DETAILED DESCRIPTION

The tubular element 1 conforming to the invention will now be described in connection with FIGS. 7 and 8. On its outer surface 10 it comprises several spaced apart annular sealing modules 2 or 2'.

Figure 7:
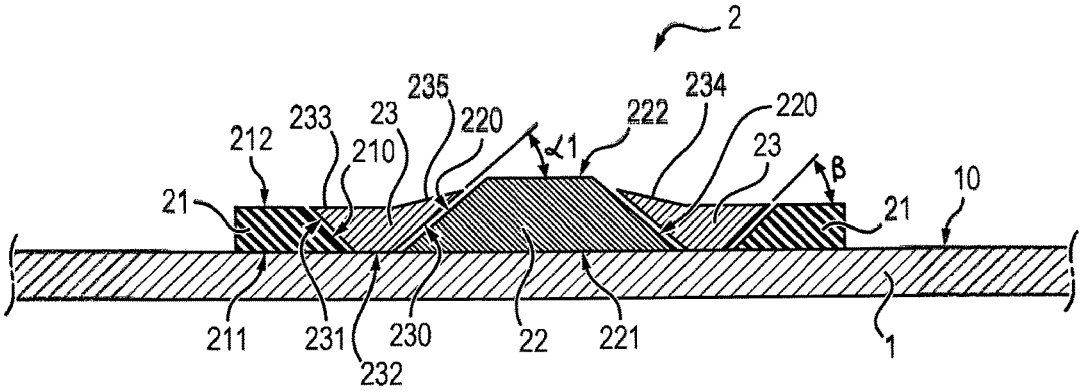
FIGS. 7 and 8 are magnified views illustrating part of an annular sealing module conforming to the invention, in two possible embodiments thereof.
Figure 8:
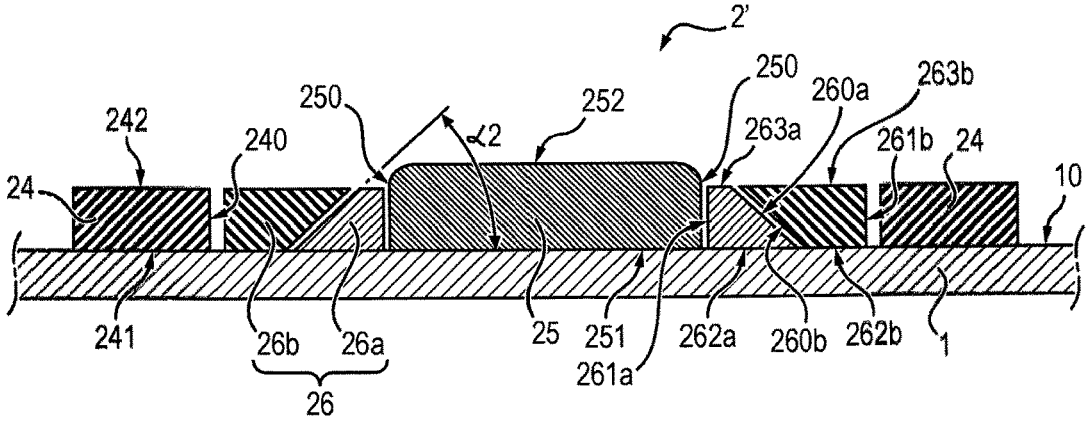

However, in these FIGS. 7 and 8 only one part, namely the upper part of the tubular element 1 and of a sealing module 2 or 2', is illustrated.

Figure 6:
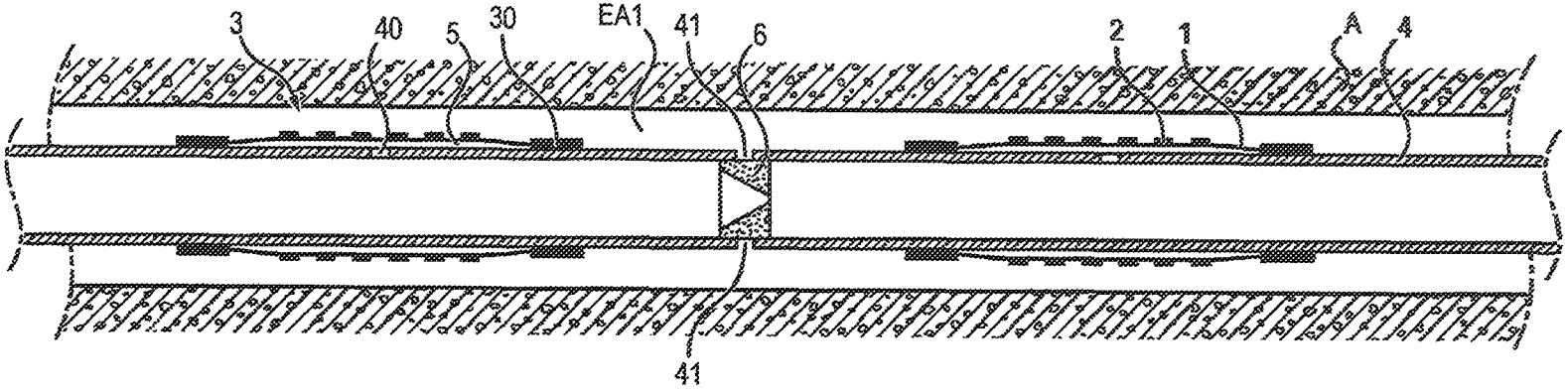
PRIOR ART FIG. 6
FIG. 6 is a schematic longitudinal sectional view of a device to isolate part of a wellbore conforming to the invention.

These elements can only be seen in their entirety in FIG. 6 which illustrates a particular application of the tubular element to the forming of a device to isolate part of a wellbore.

A first embodiment of the invention will now be described with reference to FIG. 7.

The metal tubular element 1 is radially expandable by hydroforming or using an inflatable tool.

The annular sealing module 2 comprises two annular metal abutments 21 between which there are inserted an annular seal 22 and two anti-extrusion rings 23. The annular seal 22 is placed between the two anti-extrusion rings 23.

The two annular metal abutments 21 are secured to the outer surface 10 of the metal tubular element 1, for example by welding.

The element 1 and the abutments are in steel for example. They are capable of plastic deformation.

The seal 22 is advantageously made in elastomer. The anti-extrusion rings 23 are made in an elastically and plastically deformable material for example e.g. polytetrafluoroethylene (PTFE) or poly(etheretherketone) (PEEK).

The cross-section of the annular seal 22 is in the shape of an isosceles trapezoid whose long base 221 is in contact with the outer surface 10 of the tubular element 1. The opposite surface or "short base" carries reference 222.

The two sides of the trapezoid 220 form the two bevelled lateral surfaces of the seal.

Each annular anti-extrusion ring 23 in its cross-section is in the shape of a pentagon whose inner side 232 is positioned against the outer surface 10 of the tubular element 1.

The two lateral sides of the pentagon on either side of side 232 and which correspond to the lateral surfaces of the anti-extrusion ring carry references 230 for the surface facing the seal 22 and 231 for the surface facing the metal abutment 21.

The two outer sides respectively carry reference 233 for the side close to side 231 and reference 235 for the side close to side 230.

Since the height of the abutments 21 is lower than the height of the seal 22, side 233 lies in the same horizontal plane as the upper surface of the abutment 21, whilst side 235 lies at an angle to make up the difference in level with the seal 22.

The end of each anti-extrusion ring 23 facing the seal 22 therefore has a pointed tip 234.

Finally the cross-section of the annular abutment 21 is in the shape of a rectangular trapezoid whose long base 211 is in contact with the outer surface 10 of element 1 and whose opposite short base carries reference 212.

The lateral bevelled surface of the abutment 21 facing the ring 23 is referenced 210.

The two bevelled lateral surfaces 220 and 230 are arranged opposite one another and lie at the same angle $\alpha 1$ relative to the outer surface 10 of the tube 1. This angle $\alpha 1$ is between 20° and 70°. Preferably it is 45°.

The opposite facing surfaces 210 and 231 lie at a same angle $\beta$ relative to the outer surface 10 of the tube 1.

Angle $\beta$ is preferably between 20° and 70°. More preferably it is 45°.

Angles $\alpha 1$ and $\beta$ are not necessarily identical.

A second embodiment of the sealing module referenced 2' is now described in connection with FIG. 8.

This variant of embodiment solely differs from the preceding embodiment through the shape of the cross-section of each of the elements of this module 2', namely the seal 25, annular abutments 24 and anti-extrusion rings 26 made in two parts 26*a* and 26*b*.

Each metal abutment 24 has a rectangular cross-section with one surface 240 facing the ring 26, one surface 241 in contact with the element 1 and an opposite surface 242.

The seal 25 has a rectangular cross-section. Its surface in contact with the tube 1 is referenced 251, its opposite surface 252 and its two side surfaces 250.

Finally each anti-extrusion ring 26 comprises two parts 26*a*, 26*b* in the shape of a rectangular trapezoid. These two parts are arranged head to tail so that their respective angled (bevelled) surfaces 260*a* and 260*b* face one another.

Also, part 26*b*, located close to the abutment 24, has one lateral surface 261*b* (opposite to 260*b*), a short base 262*b* arranged against the outer surface 10 of the tube 1 and a long base 263*b*.

Part 26*a* comprises a lateral surface 261*a*, opposite to 260*a*, a long base 262*a* in contact with the outer surface 10 and a short base 263*a*.

Other shapes can also be envisaged for the abutments, seal and anti-extrusion rings.

A description of the device 3 for isolating part of a wellbore conforming to the invention will now be given with reference to FIG. 6.

This device comprises a pipe 4 provided over a section of its outer surface with at least one metal tubular element 1 such as described in the foregoing.

In the Figures this element 1 is illustrated equipped with sealing modules 2. Evidently these could also be the above-described modules 2'.

Figure 1:
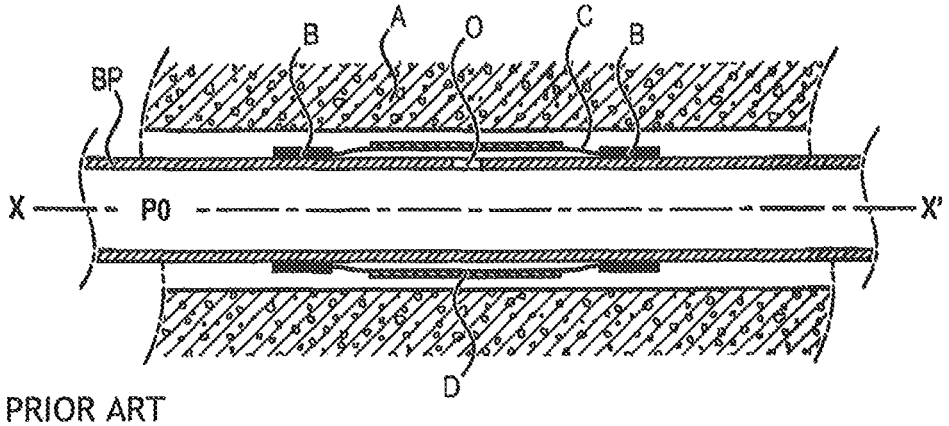
PRIOR ART FIG. 1
FIGS. 1 and 2 are schematic views along a longitudinal sectional plane of an isolating device conforming to the state of the art, in its original state and after axial deformation respectively.
Figure 2:
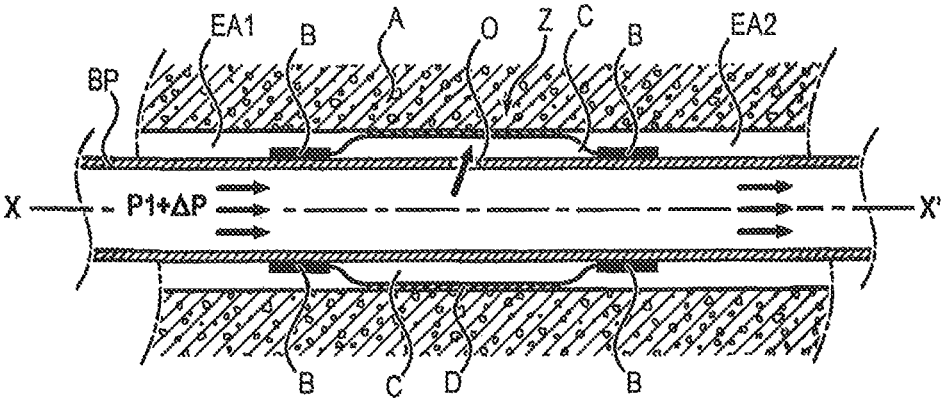
PRIOR ART FIG. 2
Figure 3:
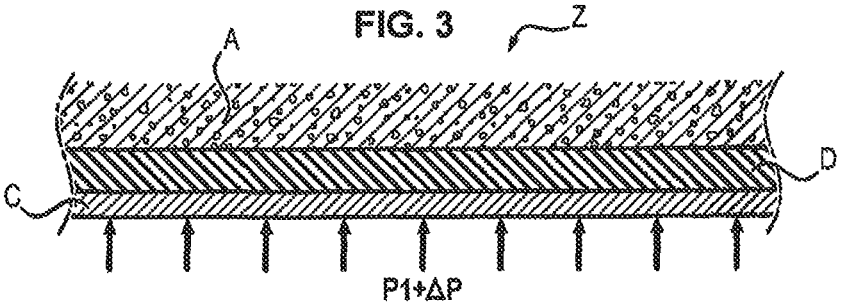
PRIOR ART FIG. 3
FIGS. 3 and 4 are detailed views of a zone Z in FIG. 2.
Figure 4:
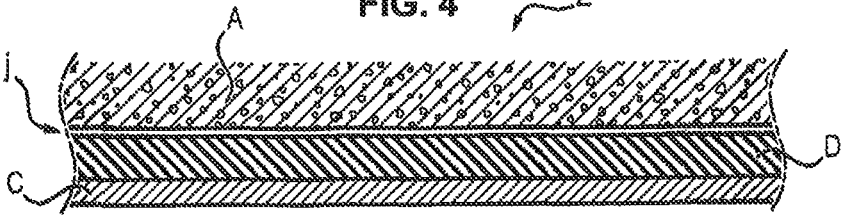
PRIOR ART FIG. 4
Figure 5:
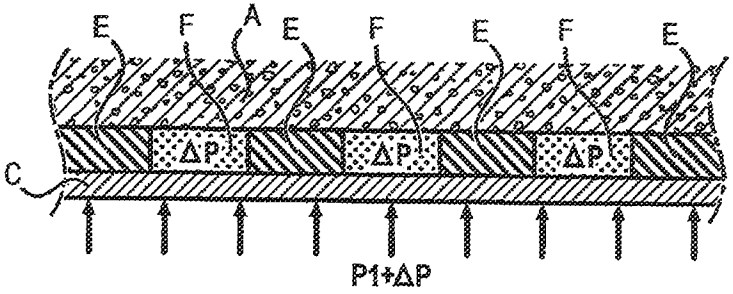
FIG. 5 is a longitudinal sectional schematic of a sealing layer of a device conforming to the state of the art.

Similar to the description given for the state of the art in connection with FIGS. 1 and 2, the tubular element 1 is sealingly secured at its opposite ends to the outer surface of the pipe 4, for example via rings 30.

At least one opening 40 is arranged in the wall of the pipe 4 to cause its inner space to communicate with the annular space 5 arranged between the wall of the pipe 4 and the tubular element 1.

The pipe 4 also has at least one through opening 41 arranged between two isolating devices 3 so as to place its inner space in communication with the outside.

These through openings 41 can be obturated via mobile shutoff means 6.

Figure 12:
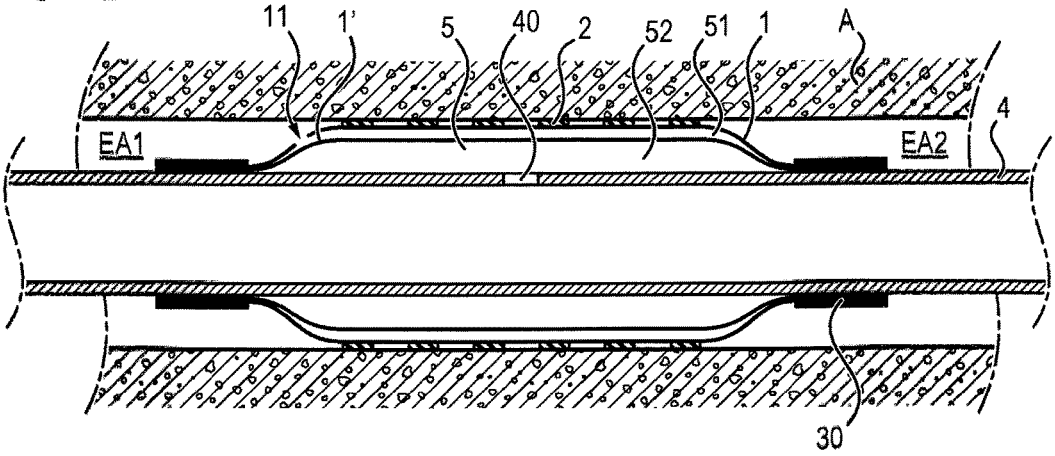
FIG. 12 is a longitudinal sectional view of a variant of embodiment of the isolating device.

A variant of the device 3 is illustrated in FIG. 12.

A second radially expandable, metal tubular element 1' is arranged inside the element 1 previously described.

The two elements 1, 1' are coaxial and are retained at their respective ends by rings 30. The second tubular element 1' does not carry any sealing module 2 or 2'.

There is at least one orifice 11 which places the annular space 51, arranged between the outer surface of element 1' and the inner surface of element 1, in communication with one of the annular spaces EA1 or EA2. According to the variant of embodiment illustrated in FIG. 12, this orifice 11 passes entirely through the thickness of the tubular element 1. It could also be located in the securing end of the tubular elements.

The method for sealed applying of the aforementioned isolating device 3 against the wall A of a wellbore or casing positioned inside this wellbore, will now be described with reference to FIGS. 9A to 9C and 11A to 11E.

Figure 11A:
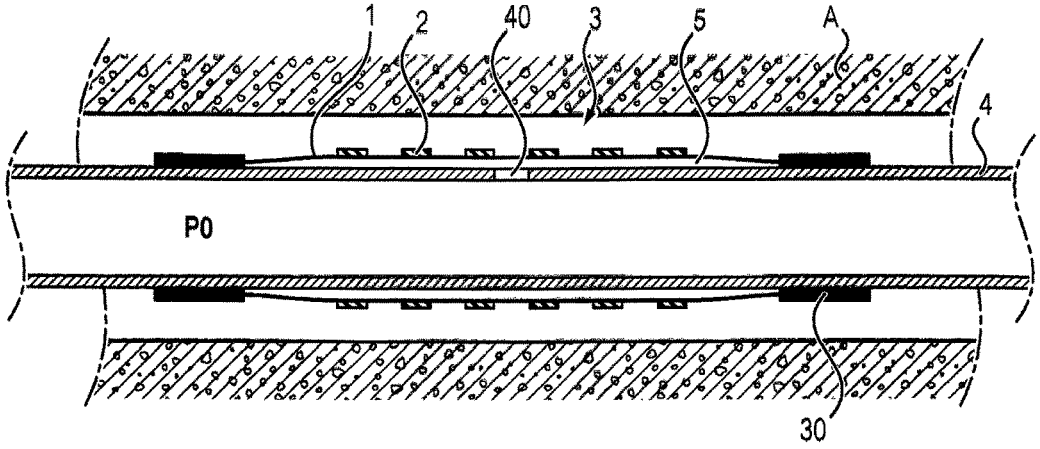
FIGS. 11A to 11E are schematics illustrating the different successive steps of the method for the sealed applying of an isolating device conforming to the invention against the wall of a wellbore.

In FIG. 11A, the isolating device 3 is shown in its initial state i.e. the tubular element 1 is not yet deformed. The wellbore is at absolute pressure P0. The openings 41 are obturated.

Figure 11B:
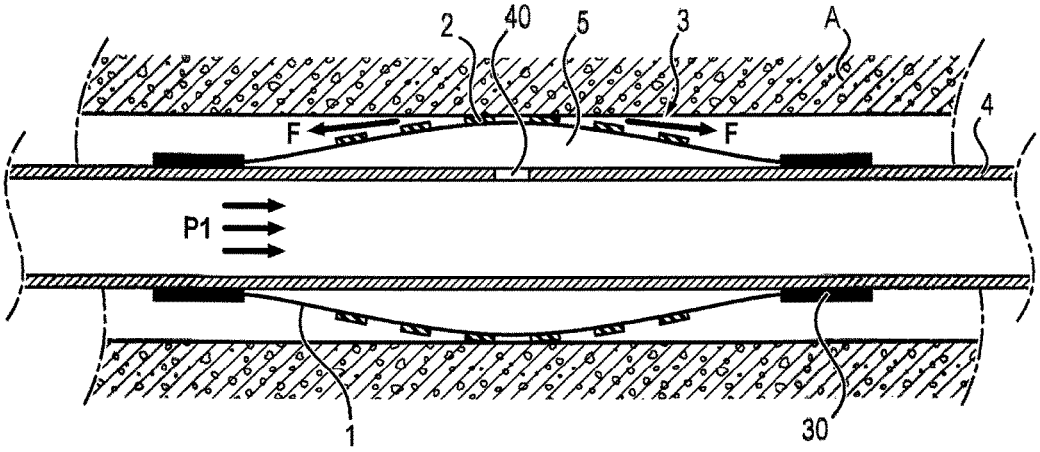

As illustrated in FIG. 11B, a fluid pressure P1 (preferably a liquid such as water) is applied inside the pipe 4. This pressure is communicated via the openings 40 to the annular space 5 which causes radial expansion of the tubular element 1 beyond its elastic deformation limit.

The sealing modules 2 located in the centre of the tubular element 1 come into contact with the wall A.

Figure 9A:
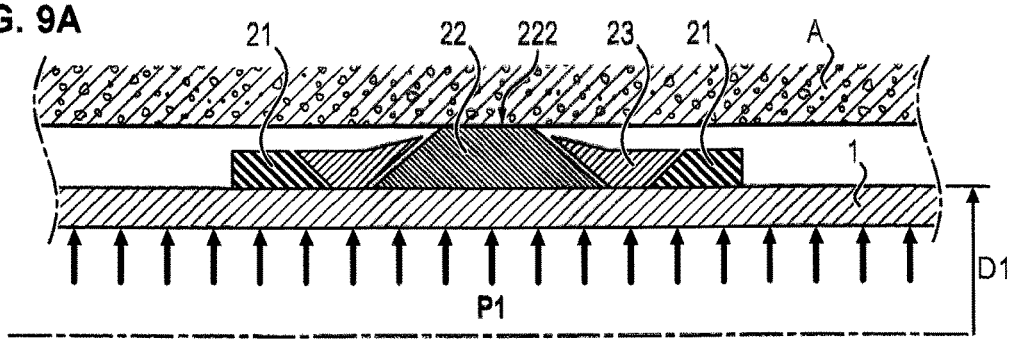
FIGS. 9A to 9D are schematics illustrating the different successive steps of the application and functioning of the expandable tubular element conforming to the invention.

At this stage and as illustrated in detail in FIG. 9A, the central diameter of the tubular element 1 is D1. The surface 222 of the seal 22 comes into contact with the wall A of the wellbore.

Figure 11C:
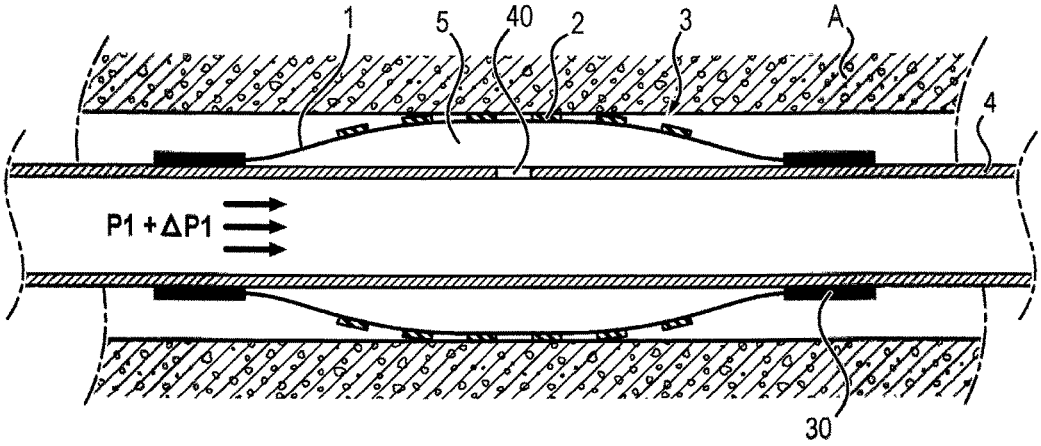

As illustrated in FIG. 11C, an overpressure ΔP1 is then applied inside the pipe 4, so that the overall pressure becomes P1+ΔP1. The central sealing modules 2 are compressed and the sealing modules located either side also come into contact with the wall A. Any water contained between the wall A and the tubular element 1 is expelled outwardly (arrows F).

Figure 9B:
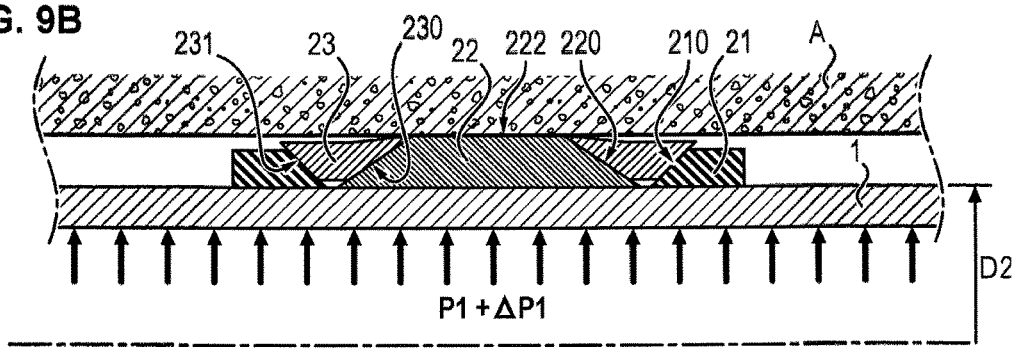

FIG. 9B gives a detailed view of the situation of the central sealing modules 2. They are more compressed against the wall A so that the seal 22 is compressed and becomes dynamic. The central diameter of the tubular element 1 becomes D2 larger than D1.

By so doing, the bevelled surfaces 220 of the seal 22 push the anti-extrusion rings 23 to the right and left. This results from sliding of the surfaces 220 and 230 relative to one another. The same applies to the bevelled surfaces 210 and 231, with the result that the two anti-extrusion rings 23 expand radially outwards in the direction of the wall A.

Figure 11D:
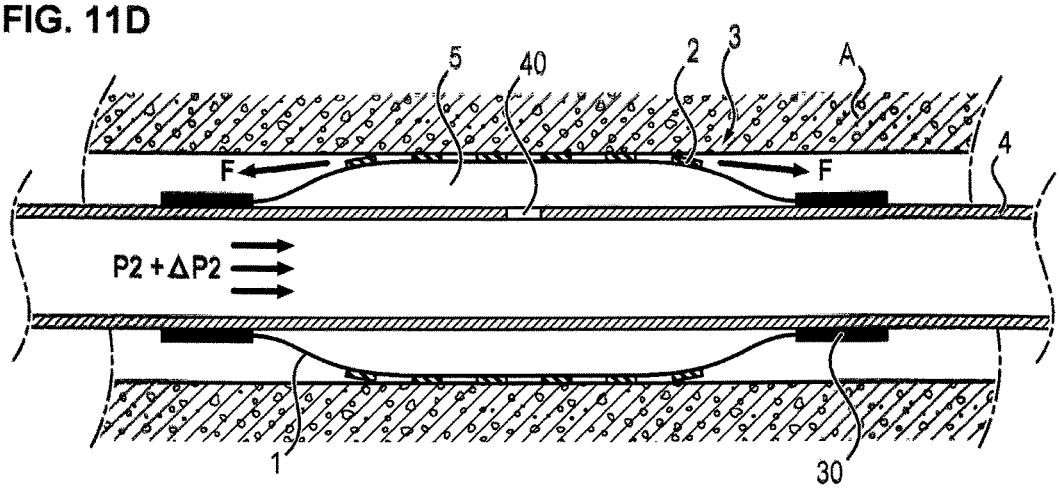
Figure 11E:
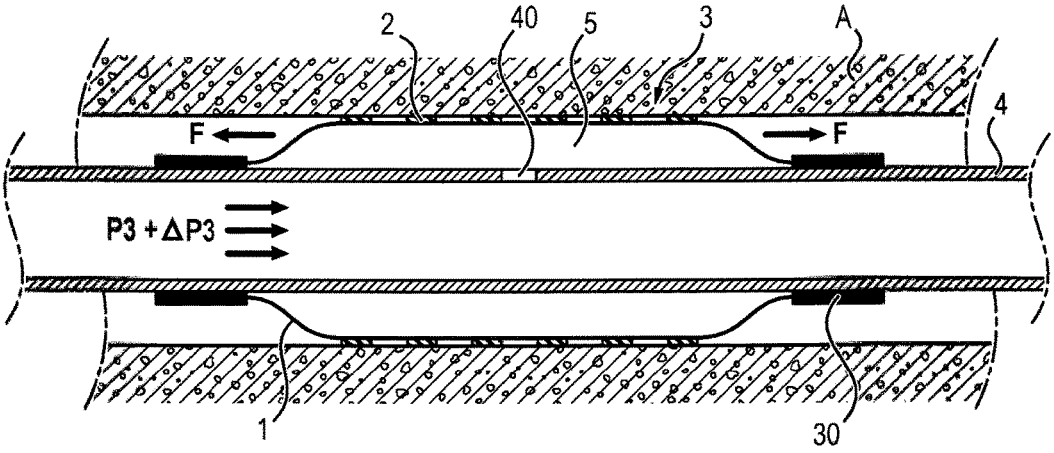

In FIGS. 11D and 11E it can be seen that by continuing the application of overpressure ΔP2 then ΔP3, the sealing modules 2 located either side of the central modules progressively come into contact with the wall A from the centre towards the ends of the tubular element 1.

Any water contained between the wall A and the device 3 continues to be expelled upstream and downstream (arrows F).

Figure 9C:
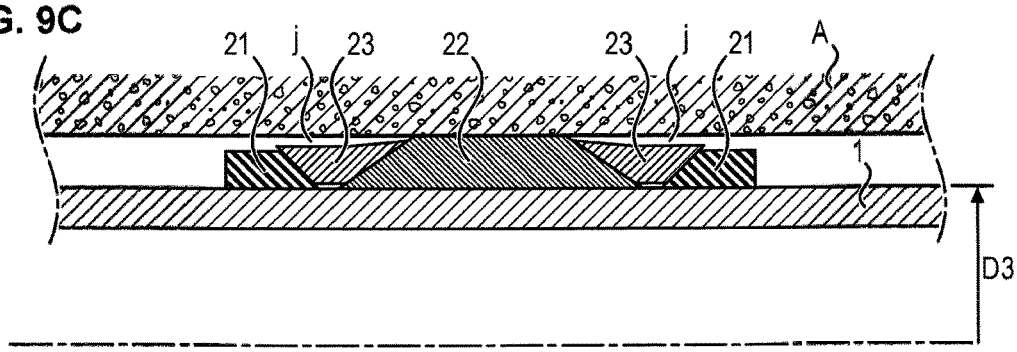

As illustrated in FIG. 9C, after the release of all pressure inside the pipe 4, and hence inside the annular space 5, the tubular element 1 undergoes elastic return. The diameter of this element 1 is slightly reduced to assume a diameter D3 between D1 and D2. In this position, the seal 22 remains in contact however with the wall A of the wellbore. On the other hand, there is a small clearance j between the wall A and the anti-extrusion rings 23.

Figure 10A:
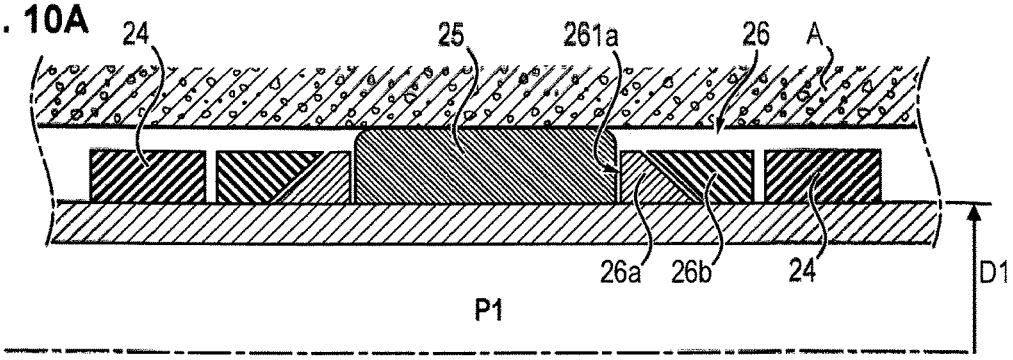
FIGS. 10A to 10D are similar views to FIGS. 9A to 9D but illustrating a different embodiment of the annular sealing module.
Figure 10B:
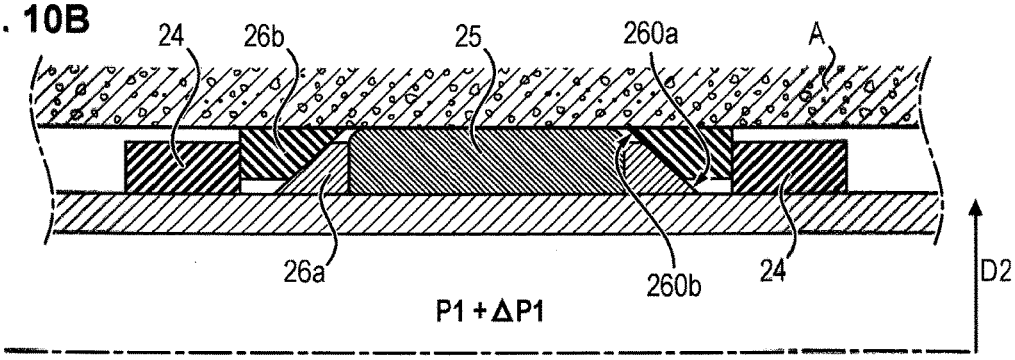
Figure 10C:
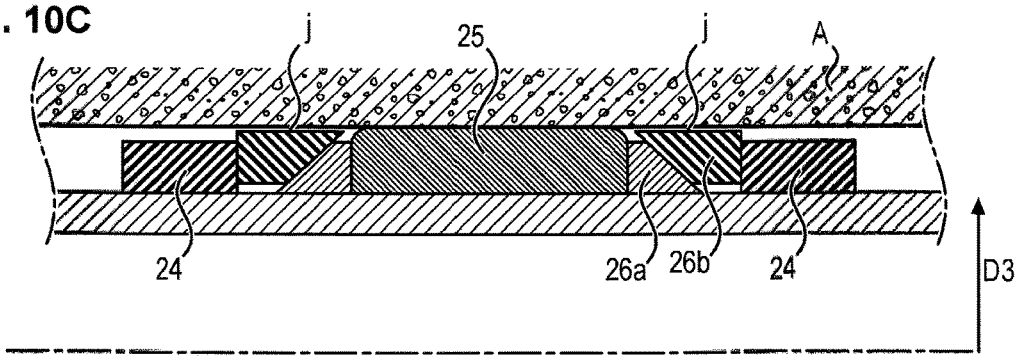

FIGS. 10A to 10C illustrate the expansion phenomenon of the tubular element 1 equipped with a sealing module 2'. The steps are similar to those described in connection with FIGS. 9A to 9C and will not be reproduced in detail herein.

When pressure P1+ΔP1 is applied, the seal 25 becomes compressed. By so doing it applies axial thrust on the surfaces 261*a* of parts 26*a* of the anti-extrusion ring. The bevelled surfaces 260*a* and 260*b* slide relative to one another so that the axial displacement of part 26*a* of the anti-extrusion rings causes radial displacement of part 26*b* in the direction of the wall A of the wellbore.

After release of the pressure inside the tubular element 1, it can be seen that parts 26*b* of the anti-extrusion rings move slightly radially downwards in the direction of the tubular element 1 (see FIG. 10C). However the seal 25 is sufficiently retained by the rings 26 and abutments 21 to remain up against the wall A ensuring a seal. There is also a clearance j between the wall A and the anti-extrusion rings 26*b*.

In the particular case of the embodiment in FIG. 12, when a fluid pressure P1, then ΔP1, ΔP2 and ΔP3 is applied inside the pipe 4, whereas the openings 41 are shut, the second tubular element 1' deforms and comes to lie flat against the inner surface of the first tubular element 1 as previously described.

After return to initial pressure PO and clearing of the openings 41, if a fluid under pressure is applied inside the annular space EA1, this pressure is communicated to inside the space 51 via the orifice(s) 11.

The space 52 arranged between the pipe 4 and the second tubular element 1' has its volume gradually reduced and this second tubular element 1' is pushed against the pipe 4. Thereby, either side of the first tubular element 1, the same balanced pressure is obtained which promotes continuation of the seal and the risk of collapse of the first tubular element 1 no longer exists.

FIGS. 11A to 11E illustrate a tubular element 1 carrying sealing modules 2 placed side by side in regular fashion. However, advantageously, it is possible to arrange the sealing modules 2 so that they are closer to each other at the ends of the metal tubular element 1 and lie further apart in the central portion of this tubular element.

Similarly, advantageously, the metal abutments 21, 24 and/or the annular seals 22, 25 of the sealing modules 2 or 2' positioned in the central portion of the tubular element 1 are advantageously narrower and/or thinner than the metal abutments 21, 24 of the sealing modules positioned at the ends of the tubular element.

These two above-mentioned particular arrangements are intended to reinforce radial deformation of the tubular element 1 so that its central portion is first applied against the wall A, and the modules on either side are progressively applied against the wall A from the centre towards the ends of the element 1.

Once the sealing devices 3 are placed in the position illustrated in FIG. 11E, it is possible to shift the sliding device 6 positioned facing the through openings 41, the effect of which is to clear the openings 41. It is then possible to inject a fluid under very high pressure inside the pipe 4. This fluid enters the annular space separating the sealing devices N and N+1.

Figure 9D:
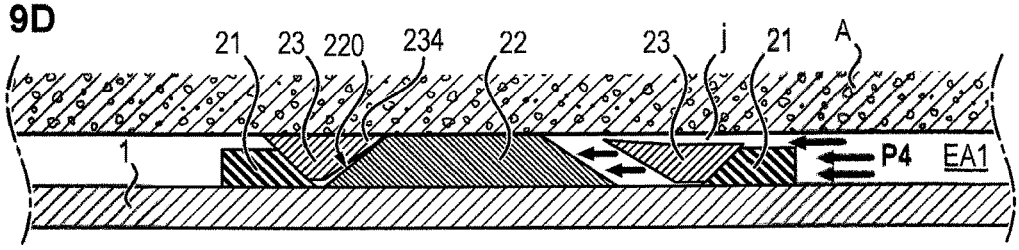

As illustrated in FIG. 9D, the pressure P4 applied in the annular space EA1 between the wellbore A, the tubular element 1 and two neighbouring devices 3 passes between one of the rings 21, the ring 23 and the wall A. This results in pushing the seal 22 up against one of the anti-extrusion 23 rings, in this case the one on the left in FIG. 9D.

The bevelled surface 220 slides in relation to the surface 230 of the ring 23 and via a «wedge» effect lifts up and causes the outward radial displacement of the anti-extrusion ring 23. The travel of this ring is retained by the abutment 21. The tip 234 fully cooperates with the shape of the seal 22 to prevent the extrusion thereof.

Figure 10D:
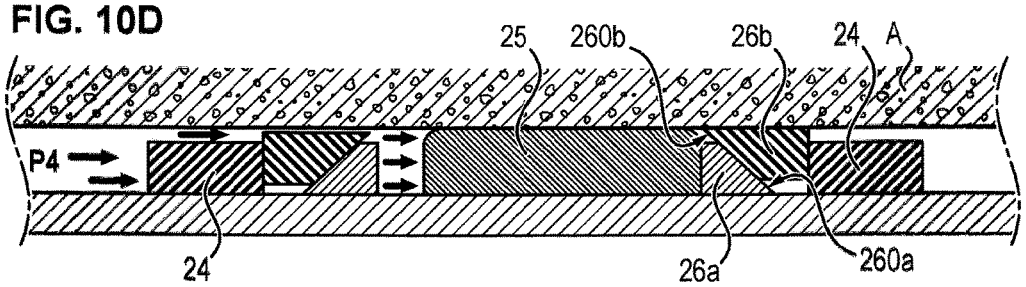

In FIG. 10D it can similarly be seen that the application of pressure P4 has the effect of displacing the seal 25 axially in the direction of the anti-extrusion ring 26. The surfaces 260*a* and 260*b* slide relative to one another and via the «wedge» effect the outer part 26*b* tends to move radially outwards in the direction of the wall A, thereby ensuring a perfect dynamic seal between the tubular element 1 and the wall A.

The invention claimed is:

1. A radially expandable metal tubular element having on its outer surface a series of spaced apart annular sealing modules, wherein each sealing module comprises two annular metal abutments between which there are inserted an annular seal and two anti-extrusion rings, the seal being positioned between the two anti-extrusion rings, and the two metal abutments being fixedly secured against the outer surface of the said radially expandable metal tubular element, wherein the two anti-extrusion rings are made in elastically and plastically deformable material and are in one or two parts and wherein the two anti-extrusion rings and/or the seal comprise at least two opposite facing bevelled surfaces capable of sliding relative to one another under the effect of axial movement of said seal, so as to cause radial outward displacement of one of the anti-extrusion rings or at least one of the two parts thereof.

2. The radially expandable metal tubular element according to claim 1, wherein each anti-extrusion ring is in a single part and in that the said bevelled surfaces are respectively arranged on each anti-extrusion ring and on each lateral surface of the seal.

3. The radially expandable metal tubular element according to claim 1, wherein each anti-extrusion ring is in two parts and in that the said bevelled surfaces are respectively arranged on each of these two parts.

4. The radially expandable metal tubular element according to claim 1, wherein the anti-extrusion rings and the metal abutment comprise at least two opposite facing bevelled surfaces capable of sliding relative to one another under the effect of axial movement of the seal, so as to cause radial outward displacement of one of the anti-extrusion rings.

5. The radially expandable metal tubular element according to claim 1 wherein the radially expandable metal tubular element is in steel of stainless type.

6. The radially expandable metal tubular element according to claim 1, wherein the metal abutments are in steel of the same type as the tubular element.

7. The radially expandable metal tubular element according to claim 1, wherein the said bevelled surfaces lie at an angle of between 20° and 70° relative to the outer surface of the tubular element.

8. The radially expandable metal tubular element according to claim 7, wherein the said bevelled surfaces lie at an angle of about 45° relative to the outer surface of the tubular element.

9. The radially expandable metal tubular element according to claim 1, wherein the anti-extrusion rings are made in material selected from among polytetrafluoroethylene (PTFE) and poly(etheretherketone) (PEEK).

10. A device for isolating part of a wellbore, wherein it comprises a pipe provided over a section of its outer surface with at least one outer radially expandable metal tubular element having on its outer surface a series of spaced apart annular sealing modules, wherein each sealing module comprises two annular metal abutments between which there are inserted an annular seal and two anti-extrusion rings, the seal being positioned between the two anti-extrusion rings, and the two metal abutments being fixedly secured against the outer surface of the said radially expandable metal tubular element, wherein the two anti-extrusion rings are made in elastically and plastically deformable material and are in one or two parts and wherein the two anti-extrusion rings and/or the seal comprise at least two opposite facing bevelled surfaces capable of sliding relative to one another under the effect of axial movement of said seal, so as to cause radial outward displacement of one of the anti-extrusion rings or at least one of the two parts thereof, wherein the opposite ends of this radially expandable metal tubular element are secured to the said outer surface of the pipe so as to delimit an annular space between the outer surface of the pipe and this radially expandable metal tubular element, the wall of the said pipe having at least one opening causing it to communicate with the said annular space, the metal tubular element being radially expandable so that over part of its length with the exception of its ends it is sealingly applied against the wall of the wellbore.

11. The isolating device according to claim 10, wherein the sealing modules provided on the said radially expandable metal tubular element are closer to one another at the ends of the said radially expandable metal tubular element and lie further apart from each other in the central portion of this tubular element.

12. The isolating device according to claim 10 wherein the metal abutments of the sealing modules located in the central portion of the radially expandable metal tubular element are narrower and/or thinner than the metal abutments of the sealing modules positioned at the ends of the radially expandable metal tubular element.

13. The isolating device according to claim 10, wherein the annular seals of the sealing modules located in the central portion of the radially expandable metal tubular element are narrower and/or thinner than the annular seals of the sealing modules located at the ends of the radially expandable metal tubular element.

14. The isolating device according to claim 10, wherein it comprises a pipe provided on one section of its outer surface with at least two of said radially expandable metal tubular elements, the portion of pipe located between the two radially expandable metal tubular elements having a set of through openings able to be obturated by mobile shut-off means.

15. The isolating device according to claim 10, wherein it comprises an inner second metal tubular element that is radially expandable and devoid of any sealing module and arranged coaxially inside the said outer tubular element and whose ends are secured to the outer surface of the pipe, and in that there is at least one orifice placing the annular space arranged between the outer surface of the inner tubular element and in the inner surface of the outer radially expandable metal tubular element, in communication with the space arranged outside of the pipe and the outer radially expandable metal tubular element.

16. A method for sealingly applying a radially expandable metal tubular element against the wall of a wellbore or casing in place inside this wellbore, this element being previously positioned inside the said wellbore or said casing, this radially expanding metal tubular element having on its outer surface a series of spaced apart annular sealing modules, wherein each sealing module comprises two annular metal abutments between which there are inserted an annular seal and two anti-extrusion rings, the seal being positioned between the two anti-extrusion rings, and the two metal abutments being fixedly secured against the outer surface of the said radially expandable metal tubular element, wherein the two anti-extrusion rings are made in elastically and plastically deformable material and are in one or two parts and wherein the two anti-extrusion rings and/or the seal comprise at least two opposite facing bevelled surfaces capable of sliding relative to one another under the effect of axial movement of said seal, so as to cause radial outward displacement of one of the anti-extrusion rings or at least one of the two parts thereof, wherein the method comprises the following steps:

a) radially expanding the said metal tubular element under a first pressure P1 until the central sealing modules come into contact with the said wall;

b) applying an increasing overpressure ΔP for a predetermined time until the sealing modules positioned either side of the central modules progressively come into contact with the said wall from the centre towards the ends of the tubular element, c) releasing the said pressure inside the said metal tubular element, the annular seals remaining in contact with the wall of the wellbore or casing.

17. The method according to claim 16, wherein steps a) and b) to apply pressure are performed by hydroforming or using an inflatable tool.

18. The method for sealingly applying an isolating device against the wall of a wellbore or casing placed inside this wellbore, this device previously being positioned inside the said wellbore or said casing, said isolating device comprising a pipe provided over a section of its outer surface with at least one outer radially expandable metal tubular element having on its outer surface a series of spaced apart annular sealing modules, wherein each sealing module comprises two annular metal abutments between which there are inserted an annular seal and two anti-extrusion rings, the seal being positioned between the two anti-extrusion rings, and the two metal abutments being fixedly secured against the outer surface of the said radially expandable metal tubular element, wherein the two anti-extrusion rings are made in elastically and plastically deformable material and are in one or two parts and wherein the two anti-extrusion rings and/or the seal comprise at least two opposite facing bevelled surfaces capable of sliding relative to one another under the effect of axial movement of said seal, so as to cause radial outward displacement of one of the anti-extrusion rings or at least one of the two parts thereof, wherein the opposite ends of this radially expandable metal tubular element are secured to the said outer surface of the pipe so as to delimit an annular space between the outer surface of the pipe and this radially expandable metal tubular element, the wall of the said pipe having at least one opening causing it to communicate with the said annular space, the metal tubular element being radially expandable so that over part of its length with the exception of its ends it is sealingly applied against the wall of the wellbore, wherein the method comprises the following steps:

a) radially expanding the said metal tubular element under a first pressure P1 until the central sealing modules come into contact with the said wall;

b) applying, for a predetermined time, an increasing overpressure ΔP until the sealing modules positioned either side of the central modules progressively come into contact with the said wall from the centre towards the ends of the tubular element;

c) releasing the said pressure inside the said metal tubular element, the annular seals remaining in contact with the wall of the wellbore or casing;

d) applying a pressure P4 in the annular space arranged between the pipe, the wall and two successive metal tubular elements until the seal is axially moved against one of the anti-extrusion rings causing outward radial displacement of the latter or of one part thereof so as to fill the clearance existing between the metal abutment and the wall of the wellbore.

* * * * *